US007348507B1

(12) United States Patent
Mahnken et al.

(10) Patent No.: US 7,348,507 B1
(45) Date of Patent: Mar. 25, 2008

(54) CABLE FOUL SENSOR

(75) Inventors: Steven D. Mahnken, Long Beach, CA (US); Jean-Suk Kim, Fullerton, CA (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 11/639,880

(22) Filed: Dec. 15, 2006

(51) Int. Cl.
*H01H 9/00* (2006.01)

(52) U.S. Cl. ..... 200/61.13; 200/61.18

(58) Field of Classification Search ..... 28/187; 57/81; 66/158–164; 139/353; 200/61.13–61.18; 254/270–276; 340/675–677; 352/155
See application file for complete search history.

(56) References Cited

U.S. PATENT DOCUMENTS 3,817,611 A * 6/1974 Brown ..... 352/155
3,943,844 A * 3/1976 Standbridge et al. ..... 100/343
4,154,324 A * 5/1979 Upton et al. ..... 191/12.2 R
4,213,019 A * 7/1980 Houp ..... 200/61.13
4,303,813 A * 12/1981 Cary ..... 200/52 R
4,363,945 A * 12/1982 Kunczynski ..... 200/61.18
4,412,367 A * 11/1983 Clement et al. ..... 19/0.25
4,598,184 A * 7/1986 Price et al. ..... 200/61.18
4,735,161 A * 4/1988 Brocklehurst ..... 112/273
5,335,895 A 8/1994 Sell
5,988,596 A 11/1999 Mitchell et al.

* cited by examiner

*Primary Examiner*—Michael A Friedhofer
(74) *Attorney, Agent, or Firm*—Muirhead and Saturnelli, LLC

(57) ABSTRACT

A cable foul sensor is provided for detecting a cable foul condition of a hoist or other cable reeling device. The cable foul condition may be sensed independently of the cable layer on a hoist cable drum. The cable foul sensor allows a cable foul condition to be detected before the cable mis-wrap caused by the foul condition extends outside of the envelope of the drum. The cable foul sensor may include an actuator having a first part and a second part disposed to form a passageway that receives a cable. At least one switch is disposed on the actuator. If the cable contacts at least one of the first part and the second part, the at least one of the first and the second part actuates the at least switch to control a winding operation of the cable.

20 Claims, 3 Drawing Sheets

CABLE FOUL SENSOR

TECHNICAL FIELD

This application is directed to the field of cable winding and, more particularly, to a cable foul sensor for detecting cable mis-wraps or other cable fouls.

BACKGROUND OF THE INVENTION

Cables, ropes, chains, cords or other type of flexible line, herein referred to generally as a "cable," may be wound onto or off of a drum by action of a motor and drive assembly that rotates the drum in connection with hoisting, winching and/or other cable reeling applications. During winding, the cable may become mis-wrapped on the drum or otherwise fouled, thereby causing operational delays or equipment damage. For example, a cable may be mis-wrapped so as to be out of alignment during the winding operation due to an excessive amount of slack in a standing portion of the cable, as a result of the cable becoming loose on the drum, and/or as a result of a failure of a level winding mechanism on the hoist. Further, a cable may be otherwise fouled due to splitting, kinks in the cable, or as a result of a broken strand of wire that may cause successive layers of wound cable to become mis-aligned.

Known cable foul sensors for cable hoists or winches use a flapper plate extending along the length of the drum. The flapper plate includes a sensing finger which extends into an opening of a cover disposed at an exterior of the drum and housing the area in which the cable is wound about the drum. A cable guide is used to guide the cable evenly onto or off of the drum. In instances where there is fouling of the cable at the drum, linear motion of the cable guide is impeded, causing the cable to wind upon itself and build-up to a height sufficient to trip the sensing finger of the flapper plate. The tripping causes an actuator to interrupt power to a motor and thereby stop the winding operation of the drum. (See, for example, U.S. Pat. No. 5,988,596 to Mitchell, et al., which is incorporated herein by reference.)

It is noteworthy that with known cable foul sensors, the winding operation is not immediately stopped upon an instance of cable fouling. Instead, the winding operation is interrupted after the mis-wrapped or otherwise fouled cable has built-up to a particular height sufficient to trip the sensing element. However, a relatively long delay between the occurrence of a cable foul and a remedial action taken in response to the foul makes it more difficult to reverse or correct any mis-alignment of the wound cable.

Accordingly, it would be desirable to provide a cable foul sensor that allows for relatively fast and efficient detecting of a cable mis-wrap or other cable foul during a winding operation.

SUMMARY OF THE INVENTION

According to the system described herein, a cable foul sensor includes an actuator having a first part and a second part disposed to from a passageway that receives a cable and at least one switch disposed on the actuator. If the cable contacts at least one of the first part and the second part, the at least one of the first part and the second part actuates the at least one switch to control a winding operation on the cable. The at least one switch may include a first switch disposed on the first part of the actuator, and a second switch disposed on the second part of the actuator. The first part and the second part may each include a plate having a contoured profile. The first switch may be disposed on the plate of the first part on a side of the first part opposite the passageway and the second switch may be disposed on the plate of the second part on a side of the first part opposite the passageway. A bracket may mount the at least one switch to the actuator. The first part and the second part may be disposed at approximately 1.5 to 2.0 cable pitches with respect to each other. The cable foul sensor may detect a cable foul that causes lag of the cable or a cable foul that causes lead of the cable during the winding operation and may detect the cable foul at an inception thereof.

According further to the system described herein, a cable winding device includes a housing, a drum disposed in the housing, and a cable foul sensor disposed on the housing, where the cable foul sensor detects a cable foul independently of a cable layer on the drum. The cable winding device may further include a level winding mechanism that controls alignment of adjacent cable windings within the cable layer during a winding operation of a cable onto the drum. The cable foul sensor may send a signal indicating detection of the cable foul or stop the winding operation when the cable foul is detected and may detect the cable foul at an inception thereof or independently of a height of the cable layer on the drum. The cable foul sensor of the cable winding device may include an actuator having a first part and a second part disposed to form a passageway that receives a cable and at least one switch disposed on the actuator, where if the cable contacts at least one of the first part and the second part, the at least one of the first part and the second part actuates the at least one switch to control a winding operation on the cable. The at least one switch may include a first switch disposed on the first part of the actuator and a second switch disposed on the second part of the actuator. The first part and the second part may each include a plate having a contoured profile, wherein the contoured profile matches an inner profile of the housing.

According further to the system described herein, a method for detecting a cable includes receiving a cable during a winding operation, winding or unwinding the cable on a drum, and detecting the cable foul during the winding operation independently of a cable layer on the drum. The cable foul may be detected by contact of the cable with a cable foul sensor. The cable foul sensor of the cable winding device may include an actuator having a first part and a second part disposed to form a passageway that receives a cable and at least one switch disposed on the actuator, where if the cable contacts at least one of the first part and the second part, the at least one of the first part and the second part actuates the at least one switch to control the winding operation.

BRIEF DESCRIPTION OF THE DRAWINGS

Embodiments of the system are described with reference to the several figures of the drawings, in which.

DETAILED DESCRIPTION OF VARIOUS EMBODIMENTS

Referring now to the figures of the drawings, the figures comprise a part of this specification and illustrate exemplary embodiments of the described system. It is to be understood that in some instances various aspects of the system may be shown schematically or may be exaggerated or altered to facilitate an understanding of the system.

Figure 1:
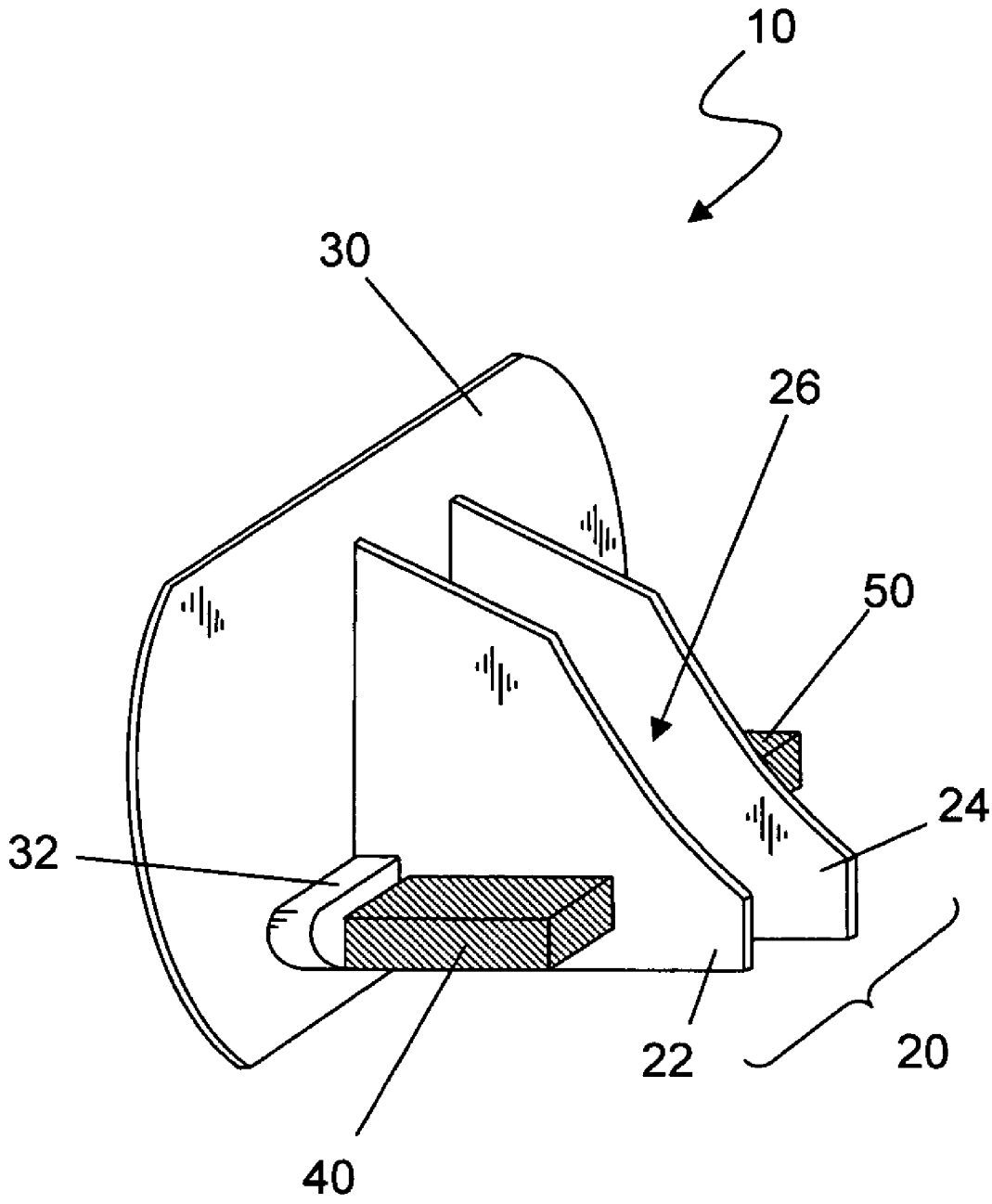
FIG. 1 is a schematic illustration of a cable foul sensor according to an embodiment of the system described herein.

FIG. 1 is a schematic illustration of a cable foul sensor 10 according to an embodiment of the system described herein. The sensor 10 includes an actuator 20 that engages with a cable. The actuator may include two plates 22, 24 (or functionally similar structure, such as blades) which extend from at least one bracket 30 to form a cable passageway 26 (or functionally similar channel) that receives the cable. The actuator 20 activates at least one of two limit switches or microswitches 40, 50 that may be positioned on either side of the plates 22, 24 and mounted on one or more flanges 32 of the bracket 30. As further described elsewhere herein, the actuator 20 of the sensor 10 is triggered by the cable as the cable starts to mis-wrap, either lag or lead, on a cable drum. For example, the actuator may be triggered when the mis-wrapped cable contacts one of the plates 22, 24 which activates one of the microswitches 40, 50 that acts to stop the hoist, for example by cutting power thereto. Other methods and configurations for actuation of the microswitches 40, 50 to signal a cable foul condition are possible. For example, electromagnetic sensors may be used. Alternatively, the cable foul sensor may be designed to operate with only one microswitch that may either sense cable fouls in both a lag or lead direction or in only one direction. Note that, for example, in the case of cable foul detection in only one direction, a switch positioned on one plate 22 of the actuator 20 would not be actuated by contact of the cable with the other plate 24.

Figure 2:
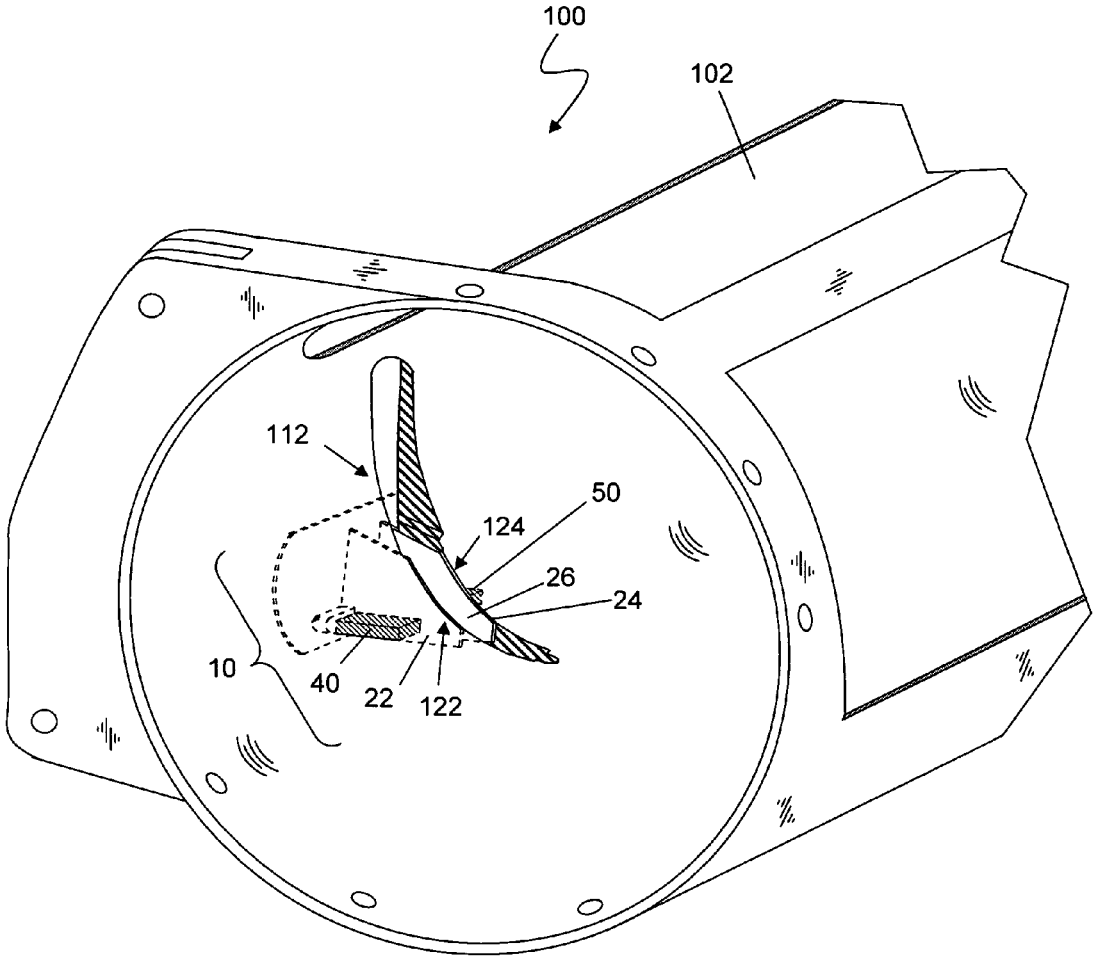
FIG. 2 is a schematic illustration of the cable foul sensor shown mounted in a main housing of a hoist, or portion thereof, according to an embodiment of the system described herein.

FIG. 2 is a schematic illustration of the cable foul sensor 10 shown mounted in a main housing 102 of a hoist 100, or portion thereof, and/or other reeling device. As illustrated, edge profiles 122, 124 of the plates 22, 24 of the sensor 10 may be contoured to match an inner profile 112 of the housing 102 in the area of the cable passageway 26 and thereby not interfere with the normal operation of the hoist 100. As further described elsewhere herein, during a winding operation, a cable is guided between the plates 22, 24 and either into or out of the housing 102 depending on whether the cable is being wound or unwound from a cable drum in the housing 102. In the event of a mis-wrap or other cable foul, contact of the cable with one of the plates 22, 24 actuates one of the switches 40, 50 to control the winding operation.

Figure 3:
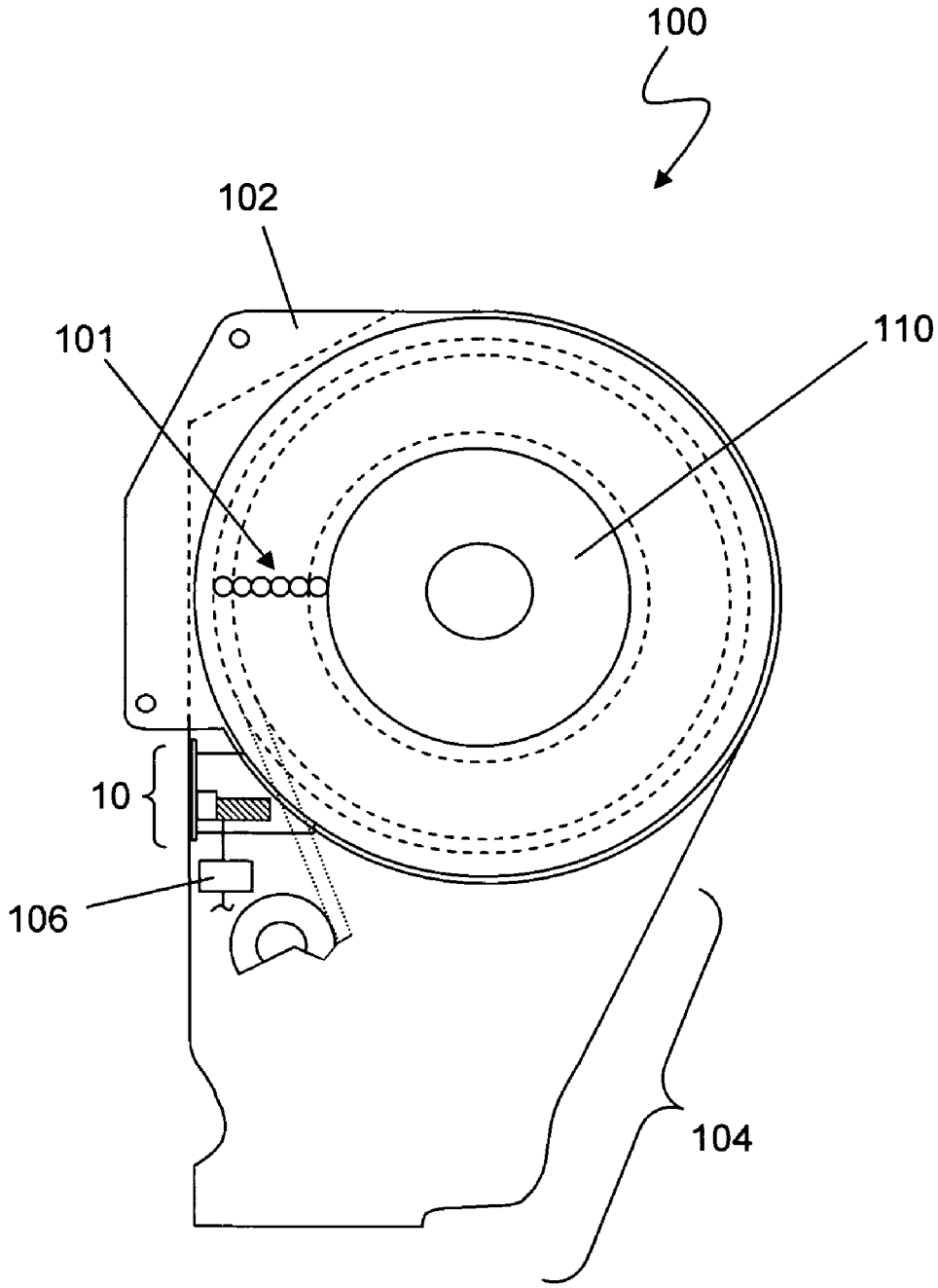
FIG. 3 is a cross-sectional view of the hoist including the cable foul sensor according to an embodiment of the system described herein.

FIG. 3 is a cross-sectional view of the hoist 100 including the cable foul sensor 10 according to an embodiment of the system described herein. As shown, the cable foul sensor 10 is positioned on the main housing 102. A motor and cable guide section 104 containing motor and guiding components receives and controls winding of a cable into layers 101 around a cable drum 110 disposed within the main housing 102. The motor and cable guide section 104 may include a level winding mechanism that controls alignment of adjacent cable windings within a cable layer as the cable is wound onto the cable drum 110. The motor and cable guide section 104 guides the cable between the plates 22, 24 of the sensor 10, through an opening in the main housing 102 and onto the cable drum 110 in the case of winding or off of the cable drum in the case of unwinding. As shown, the cable drum 110 may be a multi-layer cable drum that receives multiple cable layers 101. The motor and cable guide section 104 may be coupled to a drive assembly that rotates the cable drum 110.

As further described elsewhere herein, the sensor 10 is triggered as the cable starts to mis-wrap on the cable drum 110. The sensor may be coupled to a motor controller component 106 in the motor and cable guide section 104 that controls motor winding operations. For example, the motor controller component 106 may stop motor winding operations when one of the microswitches 40, 50 is actuated. The motor controller component 106 may also include logic that controls the winding operation depending on the type of cable foul sensed, for example automatically causing the winding operation to proceed in one direction if a cable lag foul condition is detected or in another direction if a cable lead foul condition is detected. Alternatively, the sensor 10 may alert an operator that a foul has occurred, for example by triggering a visible or audible alert to allow for operator involvement to address the cable foul.

In an embodiment herein, a mis-wrap on the drum 110 may be sensed at approximately 1.5 to 2.0 cable pitches as determined by the dimensions between plates 22, 24 of actuator 20. The sensing limit may be altered based on other desired mis-wrap sensitivity levels. For example, the actuator 20 may inscribe an envelope of approximately 2.5 inches×1.5 inches×1.5 inches and weigh approximately one half ounce. An actuator having these dimensions offers advantages in having a small size and light weight construction and in simplicity and reliability of design by using fewer numbers of parts. For example, the sensor may include five parts: one actuator, two microswitches and two microswitch brackets, as are available from Goodrich Corporation.

As discussed herein, a cable foul condition may be sensed almost immediately and independently of the cable layer on the hoist cable drum. The system described herein allows a cable foul condition to be detected before the cable mis-wrap caused by the foul condition extends outside of the envelope of the drum. As a result of quick detection, the ability to recover from a cable foul condition may be greatly improved. Further, the sensor may provide greater operation flexibility in that the motor controller logic used in connection with the foul sensor signal may result in a motor stoppage first, which then allows an operator to proceed to control the cable winding in either direction (i.e. cable up or down) to attempt to clear the cable foul condition. Note that the system described herein may work with any type of cable including, without limitation, ropes, chains, cords and/or any other type of flexible line.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A cable foul sensor, comprising:

an actuator having a first part and a second part disposed to form a passageway that receives a cable; and at least one switch disposed on the actuator, wherein the at least one of the first part and the second part actuates the at least one switch to control a winding operation on the cable in response to the cable contacting at least one of the first part and the second part, wherein contact of the cable with at least one of the first part and the second part causes detection of a cable foul.

2. The cable foul sensor according to claim 1, wherein the first part and the second part each include a plate having a contoured profile.

3. The cable foul sensor according to claim 1, further comprising:

a bracket that mounts the at least one switch to the actuator.

4. The cable foul sensor according to claim 1, wherein the cable foul sensor detects a cable foul that causes lag of the cable or a cable foul that causes lead of the cable during the winding operation.

5. The cable foul sensor according to claim 1, wherein the cable foul sensor detects a cable foul at an inception thereof.

6. A cable foul sensor, comprising:

an actuator having a first part and a second part disposed to form a passageway that receives a cable; and at least one switch disposed on the actuator, wherein the at least one of the first part and the second part actuates the at least one switch to control a winding operation on the cable in response to the cable contacting at least one of the first part and the second part, wherein the at least one switch includes a first switch disposed on the first part of the actuator, and a second switch disposed on the second part of the actuator.

7. The cable foul sensor according to claim 6, wherein the first switch is disposed on a side of the first part opposite the passageway and the second switch is disposed on a side of the second part opposite the passageway.

8. A cable foul sensor, comprising:

an actuator having a first part and a second part disposed to form a passageway that receives a cable; and at least one switch disposed on the actuator, wherein the at least one of the first part and the second part actuates the at least one switch to control a winding operation on the cable in response to the cable contacting at least one of the first part and the second part, wherein the first part and the second part are disposed at approximately 1.5 to 2.0 cable pitches with respect to each other.

9. A cable winding device, comprising:

a housing;

a drum disposed in the housing; and a cable foul sensor disposed on the housing, wherein the cable foul sensor detects a cable foul independently of a cable layer on the drum, wherein the cable foul sensor includes an actuator with a first part and a second part disposed to form a passageway that receives the cable, wherein contact of the cable with at least one of the first part and the second part causes detection of the cable foul.

10. The cable winding device according to claim 9, wherein the cable foul sensor detects the cable foul at an inception thereof and performs an action, the action including at least one of: sending a signal indicating detection of the cable foul and stopping the winding operation.

11. The cable winding device according to claim 9, wherein the cable foul sensor detects the cable foul independently of a height of the cable layer on the drum.

12. The cable winding device according to claim 9, further comprising:

a bracket that positions the cable foul sensor on the housing.

13. The cable winding device according to claim 9, further comprising:

a controller coupled to the cable foul sensor that controls the winding operation in response to detection of the cable foul.

14. The cable winding device according to claim 9, wherein the cable foul sensor includes:

at least one switch disposed on the actuator, wherein if the cable contacts at least one of the first part and the second part, the at least one of the first part and the second part actuates the at least one switch to control a winding operation on the cable.

15. The cable winding device according to claim 14, wherein the first part and the second part each include a plate having a contoured profile and wherein the contoured profile matches an inner profile of the housing.

16. The cable winding device according to claim 9, wherein the housing is a main housing of a hoist and the drum is a hoist cable drum.

17. A cable winding device, comprising:

a housing;

a drum disposed in the housing;

a cable foul sensor disposed on the housing, wherein the cable foul sensor detects a cable foul independently of a cable layer on the drum; and a level winding mechanism that controls alignment of adjacent cable windings within the cable layer during a winding operation of a cable onto the drum.

18. A cable winding device, comprising:

a housing;

a drum disposed in the housing; and a cable foul sensor disposed on the housing, wherein the cable foul sensor detects a cable foul independently of a cable layer on the drum, and wherein the cable foul sensor includes:

an actuator including a first part and a second part disposed to form a passageway that receives a cable; and at least one switch disposed on the actuator, wherein if the cable contacts at least one of the first part and the second part, the at least one of the first part and the second part actuates the at least one switch to control a winding operation on the cable, wherein the at least one switch includes a first switch disposed on the first part of the actuator, and a second switch disposed on the second part of the actuator.

19. A method for detecting a cable foul, comprising:

receiving a cable during a winding operation;

winding or unwinding the cable on a drum;

detecting a cable foul during the winding operation independently of a cable layer on the drum, wherein the cable foul is detected by contact of the cable with a cable foul sensor, the cable foul sensor including an actuator with a first part and a second part disposed to form a passageway that receives the cable, wherein contact of the cable with at least one of the first part and the second part causes detection of the cable foul.

20. The method according to claim 19, further comprising:

providing at least one switch disposed on the actuator, wherein if the cable contacts at least one of the first part and the second part, the at least one of the first part and the second part actuates the at least one switch to control the winding operation.

* * * * *